US012497865B2

(12) United States Patent
Steele et al.

(10) Patent No.: US 12,497,865 B2
(45) **Date of Patent: *Dec. 16, 2025**

(54) MULTILATERAL JUNCTION

(71) Applicant: HALLIBURTON ENERGY SERVICES, INC, Houston, TX (US)

(72) Inventors: David Joe Steele, Carrollton, TX (US); Christian Alexander Jelly, Perth (AU); Espen Dahl, Tananger (NO)

(73) Assignee: HALLIBURTON ENERGY SERVICES, INC, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/653,931

(22) Filed: May 2, 2024

(65) Prior Publication Data

US 2024/0280000 A1 Aug. 22, 2024

Related U.S. Application Data

(62) Division of application No. 17/001,412, filed on Aug. 24, 2020, now Pat. No. 12,006,797.

(51) Int. Cl.
*E21B 41/00* (2006.01)
*E21B 17/042* (2006.01)

(52) U.S. Cl.
CPC ..... *E21B 41/0042* (2013.01); *E21B 17/042* (2013.01)

(58) Field of Classification Search
CPC ..... E21B 17/042; E21B 17/0423; E21B 17/0426; E21B 41/0042
See application file for complete search history.

(56) References Cited

U.S. PATENT DOCUMENTS 3,020,959 A * 2/1962 Nutter ..... E21B 33/1292 166/212
4,676,528 A 6/1987 Gray
(Continued)

FOREIGN PATENT DOCUMENTS

RU 2608375 C2 1/2017
RU 2613685 C1 3/2017
(Continued)

OTHER PUBLICATIONS

Halliburton; "FlexRite® Multibranch Inflow Control (MIC) System"; https://www.halliburton.com/en-US/ps/completions/well-completions/multilateral-systems/mutilateral-completion-systems/flexrite-multibranch-inflow-control-mic-system.html; retrieved Jan. 13, 2021.

(Continued)

*Primary Examiner* — Yanick A Akaragwe
(74) *Attorney, Agent, or Firm* — DeLizio, Peacock, Lewin & Guerra LLP

(57) ABSTRACT

A multilateral junction comprising a y-block, lateral legs, and a transition sub for use in downhole well environments. The y-block includes a main bore and lateral bores with main bore and the lateral bores having threaded interfaces. The transition sub also includes lateral bores with threaded interfaces for receiving the lateral legs that also have threaded interfaces. The threaded interfaces of the lateral bore of the y-block has a less number of threads than the threaded interfaces of the lateral bores of the transition sub. The lateral leg includes another threaded interface that couples with the threaded interface of the lateral bore. Another end of each lateral leg includes an interface, e.g. a threaded interface, which couples with an interface of a transition sub. The main bore has an internal diameter that is greater than the internal diameter of the lateral bore.

19 Claims, 11 Drawing Sheets

(56) References Cited

U.S. PATENT DOCUMENTS

| | | | | |
|---|---|---|---|---|
| 4,898,243 | A | 2/1990 | Lindsey et al. | |
| 5,311,936 | A | 5/1994 | McNair et al. | |
| 7,497,264 | B2 | 3/2009 | Moody et al. | |
| 8,376,066 | B2 | 2/2013 | Steele et al. | |
| 8,701,775 | B2 * | 4/2014 | Steele | E21B 41/0035 166/50 |
| 2003/0159827 | A1 * | 8/2003 | Steele | E21B 33/122 166/242.6 |
| 2004/0238172 | A1 | 12/2004 | Collins et al. | |
| 2006/0201677 | A1 | 9/2006 | Moody et al. | |
| 2013/0175047 | A1 | 7/2013 | Steele et al. | |
| 2014/0000914 | A1 | 1/2014 | Steele | |
| 2014/0102808 | A1 | 4/2014 | Drenth | |
| 2015/0233190 | A1 | 8/2015 | Wolf et al. | |
| 2016/0145956 | A1 | 5/2016 | Dahl et al. | |
| 2016/0273312 | A1 | 9/2016 | Steele et al. | |
| 2017/0058647 | A1 * | 3/2017 | Langlais | E21B 17/02 |
| 2017/0107794 | A1 | 4/2017 | Steele | |

FOREIGN PATENT DOCUMENTS

| | | | |
|---|---|---|---|
| RU | 2651659 | C1 | 4/2018 |
| RU | 2651677 | C1 | 4/2018 |
| WO | 2015023249 | A1 | 2/2015 |

OTHER PUBLICATIONS

Dirk Doornhof, et al.; "Compaction and Subsidence"; Oilfield Review; Autumn 2006; p. 50-68.

TMK; Premium connections; "https://www.tmkup.ru/en/connections"; retrieved Jan. 13, 2021.

TMK; TMK up Centum; "https://www.tmkup.ru/en"; retrieved Jan. 13, 2021.

TMK; Licensees Map; "https://www.tmkup.ru/en/LicenseesMap"; retrieved Jan. 13, 2021.

International Search Report and Written Opinion issued in corresponding PCT Application No. PCT/US2020/047668; mailed Nov. 30, 2020.

* cited by examiner

MULTILATERAL JUNCTION

CROSS-REFERENCE TO RELATED APPLICATIONS

This application is a Divisional of U.S. application Ser. No. 17/001,412, filed Aug. 24, 2020, which claims priority to and benefit of U.S. Provisional Patent Application No. 62/894,589, filed Aug. 30, 2019, the disclosures of which are incorporated herein by reference in their entirety.

BACKGROUND

Lateral junctions are used in development and production of hydrocarbon reservoirs. Traditionally, the lateral junction comprises a main bore for coupling with main bore tubulars and a lateral bore that is in communication with the main bore. The main bore and lateral bore are separate units that are welded together. Because it is desirable to have a main bore with a maximum internal diameter so as to have maximum throughput, the lateral bore is manufactured to have a D-shape. A D-shaped lateral leg is then welded into the D-shaped lateral bore. However, although the main bore has an increased internal diameter, it also results in a decrease in compression rating and collapse rating of the lateral leg or legs.

In some downhole hydrocarbon reservoir formations, see FIG. 2, subsidence in a formation created during an extraction process can increase the amount of pressure on production tubing, including the lateral legs. In these situations, pore water pressure decreases but the weight of the collapsed formation doesn't decrease. As such, the stress on the lateral leg will increase. How those stresses are applied to the lateral leg depend upon the characteristics of the formation the junction is in. In a Norwegian chalk field, e.g., the formation flows like toothpaste. In a sandstone formation it depends on if the sandstone is highly-cemented or not. Shales can range from "hard as a rock" to "toothpaste," also known as bubblegum shale. A worst case scenario is the toothpaste shale where the pressures are similar to water. In this particular situation, the collapse pressure surrounding a lateral leg is uniform. The uniform collapse pressure can be a significant problem for the structural integrity of the D-shaped lateral.

In these particular downhole environments, the materials used to manufacture the junctions should have a hardness level of less than 250 HV (Vickers Pyramid Number). This hardness level is also a requirement for ANSI (American National Standards Institute)/NACE MR0175 approved junctions. However, the oil and gas industry has been unable to provide a low-cost, NACE (National Association of Corrosion Engineers) approved (Multibranch Inflow Control) MIC-type, welded junction without using high-priced materials. As such, there is a need for a lower cost junction with acceptable hardness level, NACE approved MIC-type lateral junction that also includes a lateral bore or bores that do not require a reduction in the internal diameter of the main bore.

BRIEF DESCRIPTION OF THE DRAWINGS

For a more complete understanding of the features and advantages of the present disclosure, reference is now made to the detailed description along with the accompanying figures in which corresponding numerals in the different figures refer to corresponding parts and in which.

DETAILED DESCRIPTION

While various embodiments of the present disclosure are discussed in detail below, it should be appreciated that the present disclosure provides many applicable inventive concepts, which can be embodied in a wide variety of specific contexts. The specific embodiments discussed herein are merely illustrative and do not delimit the scope of the present disclosure. In the interest of clarity, not all features of an actual implementation may be described in the present disclosure. It will of course be appreciated that in the development of any such actual embodiment, numerous implementation-specific decisions must be made to achieve the developer's specific goals, such as compliance with system-related and business-related constraints, which will vary from one implementation to another. Moreover, it will be appreciated that such a development effort might be complex and time-consuming but would be a routine undertaking for those of ordinary skill in the art having the benefit of this disclosure.

Presented herein is a lateral junction for coupling with tubing sections and lateral legs for use in a downhole well development and production environment. Also presented herein is a transition sub for coupling with the lateral legs so that the junction can be tied into another tubing section. The lateral junction comprises a y-block that includes formed therein a main bore and lateral bores. The main bore can couple with production tubing and each lateral bore couples with a lateral leg. Each lateral bore is threaded and couples with one end of a threaded, round shaped lateral leg. The other end of the lateral leg includes an interface, e.g. a threaded interface, which couples with the transition sub. The lateral junction has a hardness level of less than 250 HV and, therefore, burst, collapse, and compressional ratings suitable for use in all types of sandstone formations. The lateral junction is capable of withstanding high concentrations of stress due to formation subsidence, e.g. subsidence in bubblegum shale formations. Because welds are not required to couple the lateral legs with the junction, carbon and low-alloy steels, corrosion-resistant alloys, and other alloys can be used to manufacture a MIC-type lateral junction. Manufacturing the junction using the aforementioned y-block with integrated bores, threads, and materials results in a low-cost, MIC-type junction that meets ANSI/NACE MR0175 standards while maximizing throughput of the main bore. The terms lateral leg as used herein also means round shaped tubular.

Figure 1:
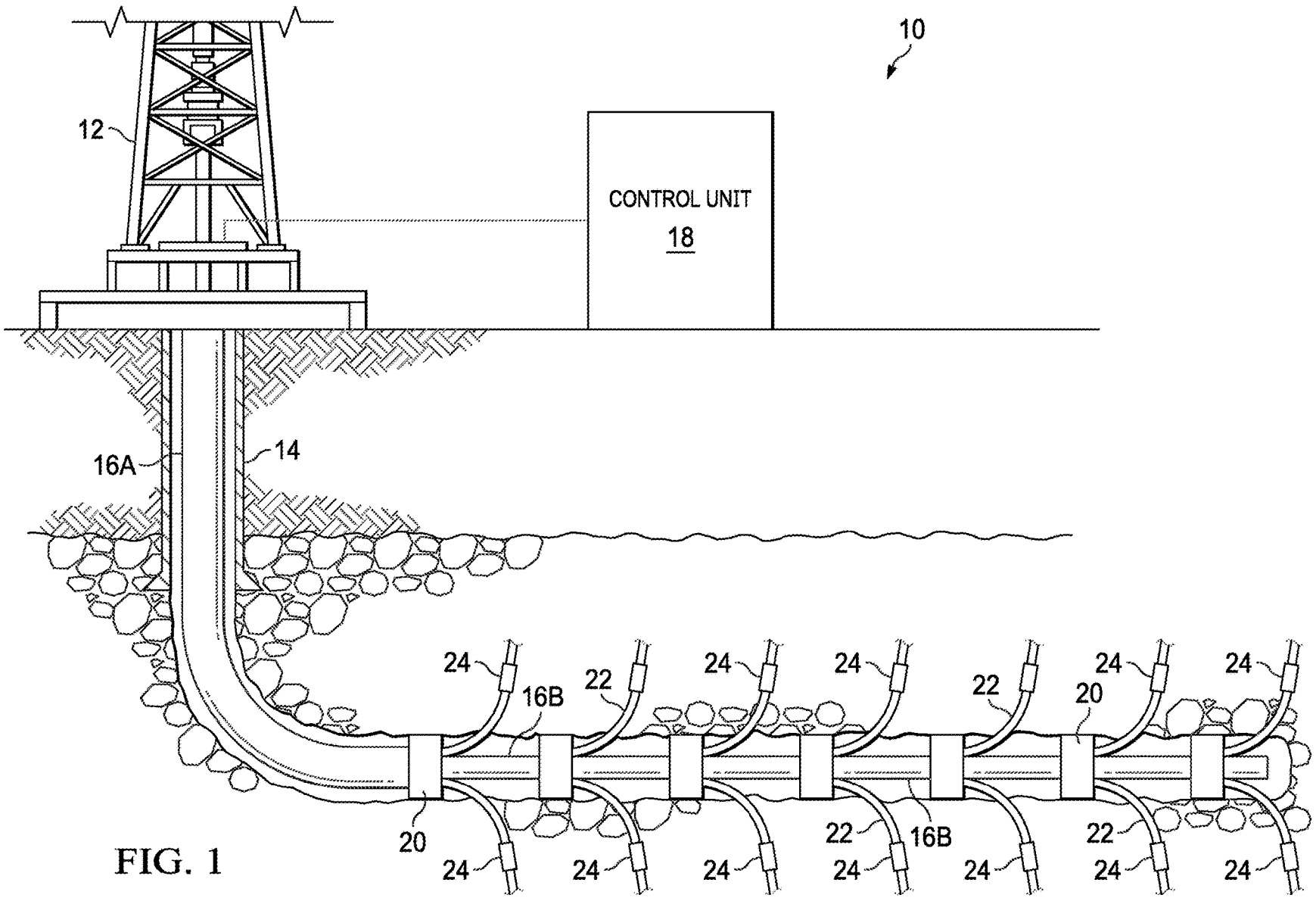
FIG. 1 is an illustration of a diagram of a well for producing hydrocarbon products, in accordance with certain example embodiments.
Figure 2:
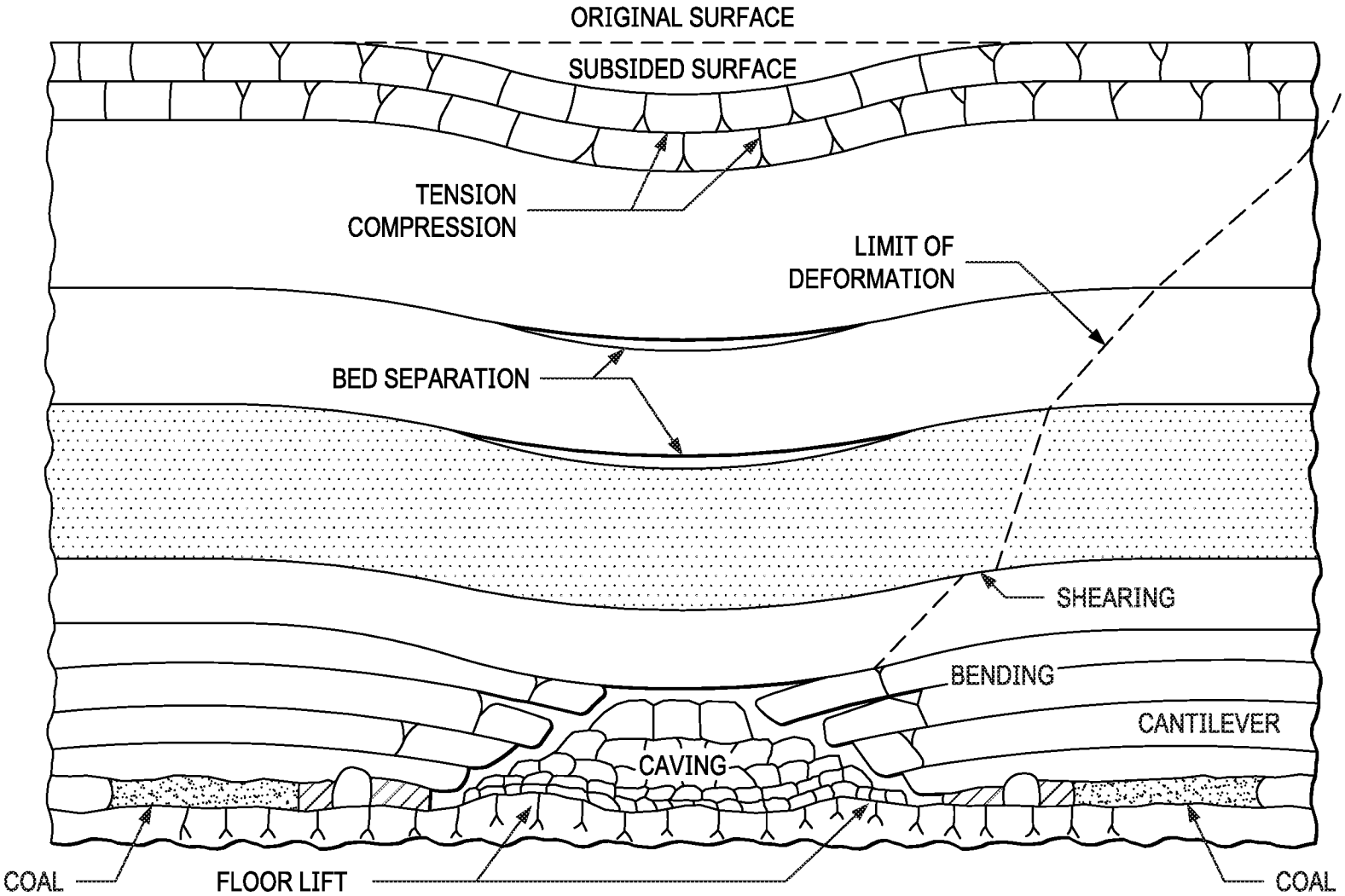
FIG. 2 is an illustration of an earth formations including a hydrocarbon formation and the affects extraction operations can have on the formations in the form of subsided surfaces, in accordance with certain example embodiments.

Referring now to FIG. 1, illustrated is a diagram of a well for producing hydrocarbon products, according to certain example embodiments, denoted generally as 10. The well 10 comprises a pump 12, well casing 14, tubing sections 16A, 16B, multilateral junctions, and a control unit 18. Each lateral junction comprises a y-block 20, lateral legs 22, and a transition sub 24. The control unit 18 can provide power to and controls operation of the pump 12 to either draw fluid from a hydrocarbon formations, such as shale formations, in an earth formation or inject fluid into a hydrocarbon formation or earth formation. The fluid can traverse the tubing sections 16A, main bore legs 16B, the y-block 20, lateral legs 22, and the transition subs 24. The y-block 20 comprise a main bore and lateral bores formed therein. The internal diameter of the main bore being larger than the internal diameter of the lateral bore. The lateral bores are threaded. Each lateral leg 22 has a threaded interface on the end that couples with the lateral bores. The other end of the lateral leg 22 comprises an interface, e.g. a threaded interface, which couples with a bore in the transition sub 24. The lateral junctions provides several advantages. Since bores in the lateral junction are rounded and threaded, low-cost, industry standard tubulars can be used. In other words, the manufacture of expensive, D-shaped tubulars is not required. Because round shaped legs or tubulars can be used, the compression, burst, and collapse ratings are increased, in comparison to the D-shaped tubes or other similar shaped tubes. Because of the increased collapse and compressions ratings, types of materials to manufacture the lateral junction can be selected so that the junction can be a NACE-approved MIC-type junction. Furthermore, because the lateral legs 22 are not required to be welded to the lateral junction and transition sub 24, the costs associated with welding and inspection is eliminated.

Figure 3A:
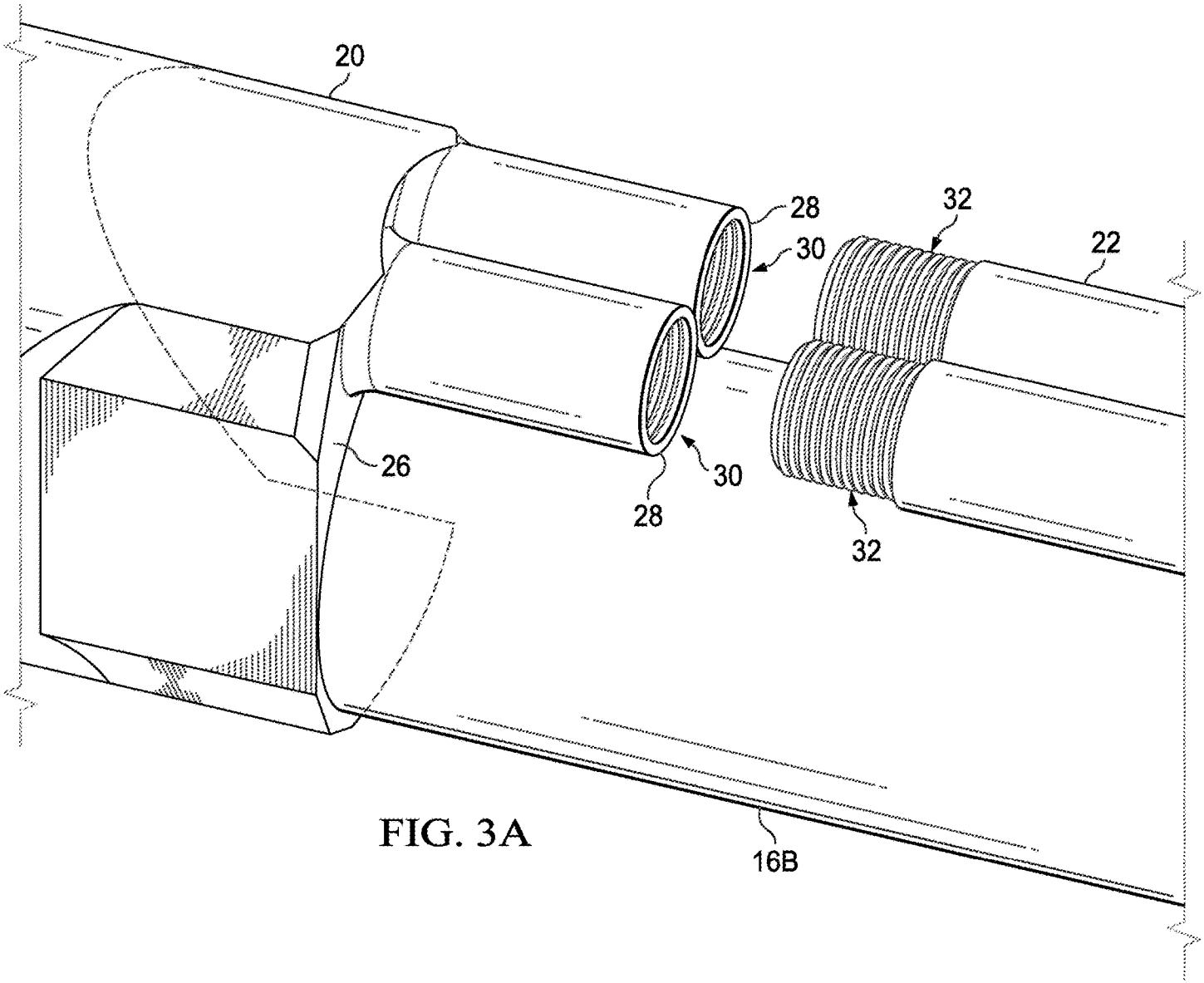
FIGS. 3A-3D are illustrations of isometric views and cut away views of a multilateral junction comprising a y-block 20, lateral legs, and a transition sub, in accordance with certain example embodiments.

Referring now to FIGS. 3A-3D, illustrated are isometric views and cut away views of a multilateral junction comprising the y-block 20, lateral legs 22, and a transition sub 24. In FIG. 3A, the multilateral junction is in a decoupled state. The multilateral junction comprises the y-block 20 having a main bore 26 that couples with main bore leg 16B, lateral bores 28 each having a threaded interface 30, and lateral legs 22 each having a threaded interface 32. The main bore 26 has an internal diameter larger than the internal diameter of the lateral bore. The main bore 26 has an internal diameter, see table 1, which can accommodate the passage of certain tools. This can be beneficial during the well completion phase.

TABLE 1

| Junction Type | System (Casing) Size | OD (Outer Diameter) of Junction | Size of Tool that can pass thru Main bore Leg | Ratio (Size of Tool that can pass thru Main bore Leg/OD of Junction) |
|---|---|---|---|---|
| MIC | 10¾" | 9.375" | 5.875" | .627 |
| MIC | 9⅝" | 8.375" | 4.785" | .571 |
| MIC | 7⅝" | 6.50" | 3.423 | .537 |

Figure 3B:
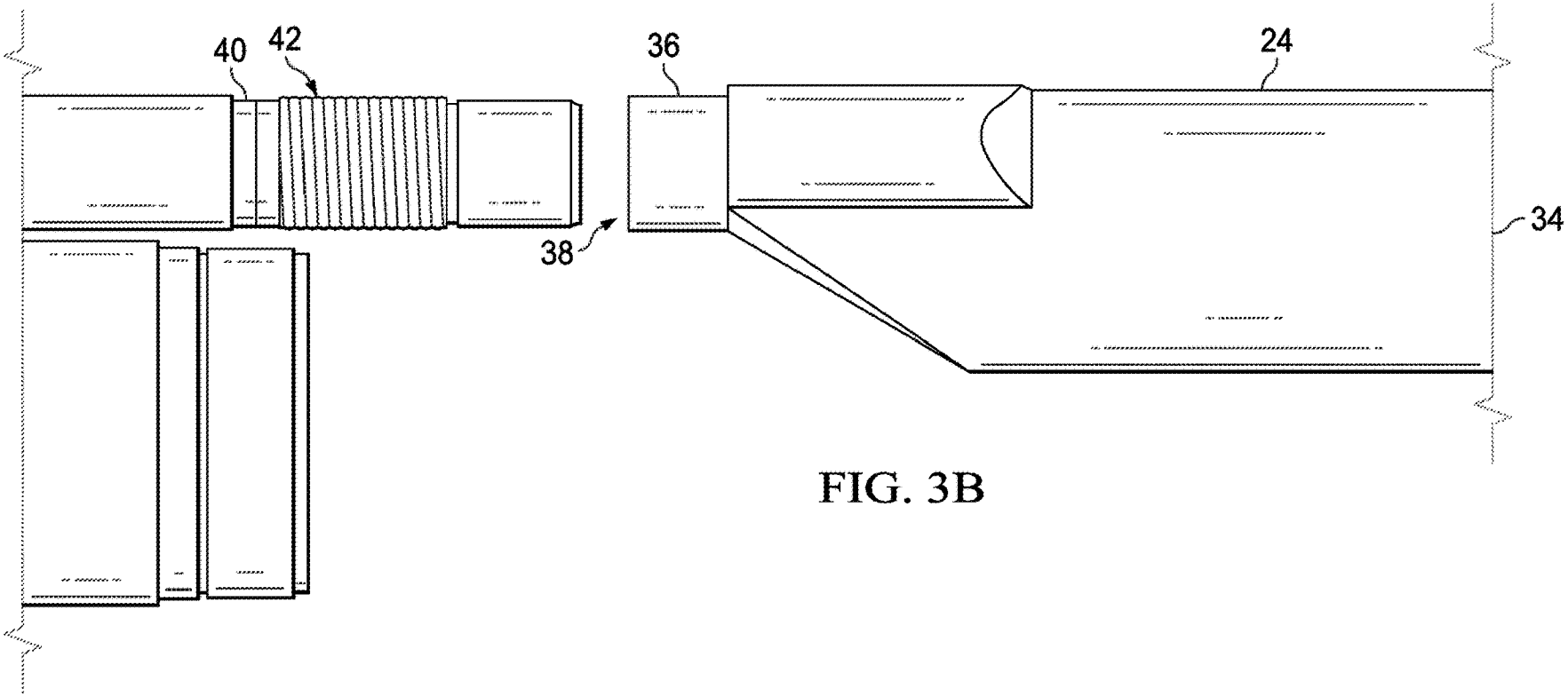

Each threaded interface 32 of each lateral leg 22 can couple with the threaded interface 30 of each lateral bore 28. Although the multilateral junction illustrated only includes two lateral legs 22, it should be understood that other configurations are also possible. In FIG. 3B, the main bore leg 16B, lateral leg 22, and the transition sub 24 of the multilateral junction are in a decoupled state. The transition sub 24 comprises a transition bore 34 and a lateral bore 36 for each lateral leg 22. Each lateral bore 36 of the transition sub 24 also includes a threaded interface 38. The lateral leg 22 comprises a threaded interface 42 and a gasket 40, e.g. a gasket made of elastomer or metal. After the multilateral junction is assembled, the gasket 40 creates a hydraulic seal with the internal framework of the transition sub 24.

Figure 3C:
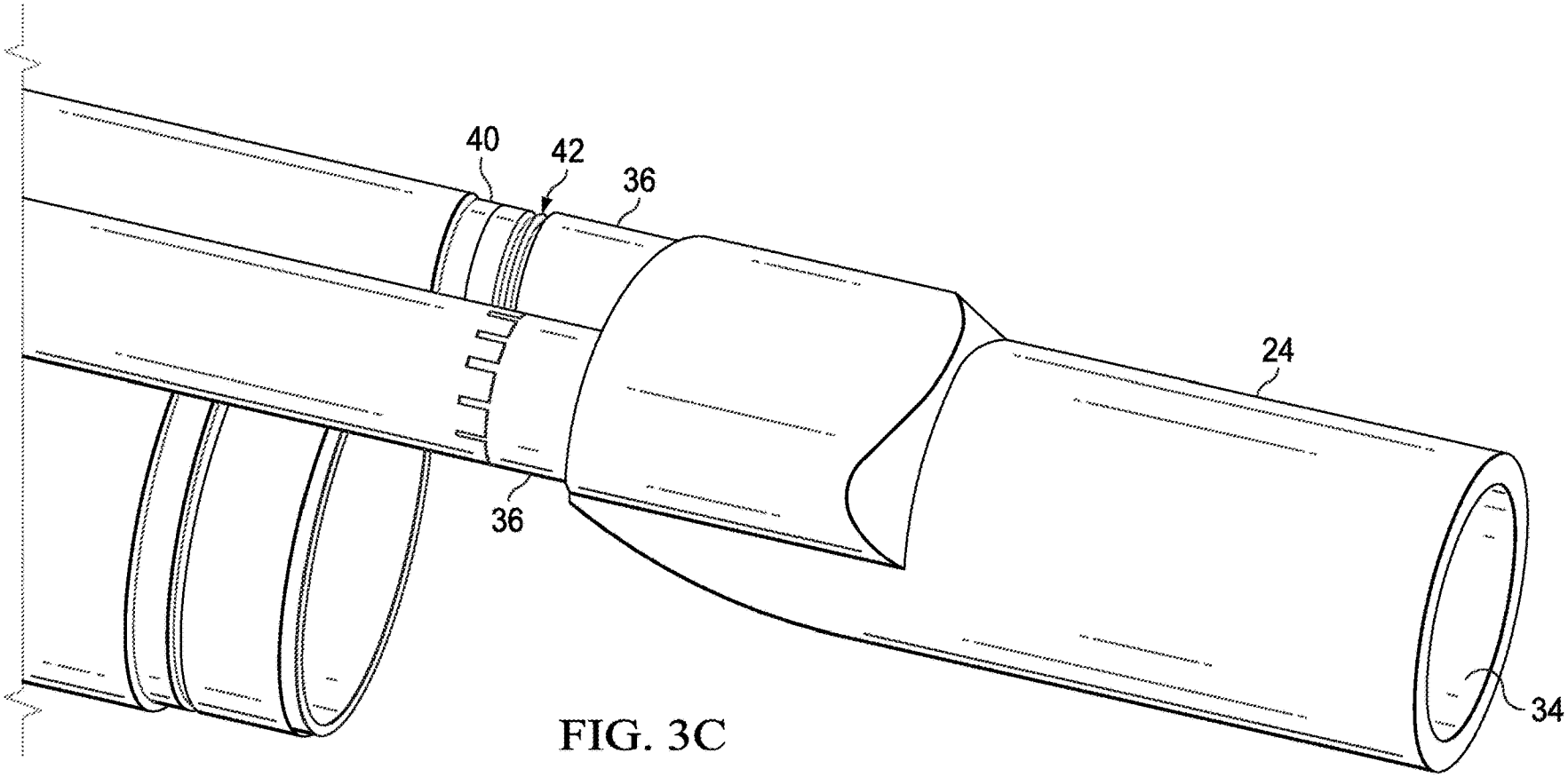
Figure 3D:
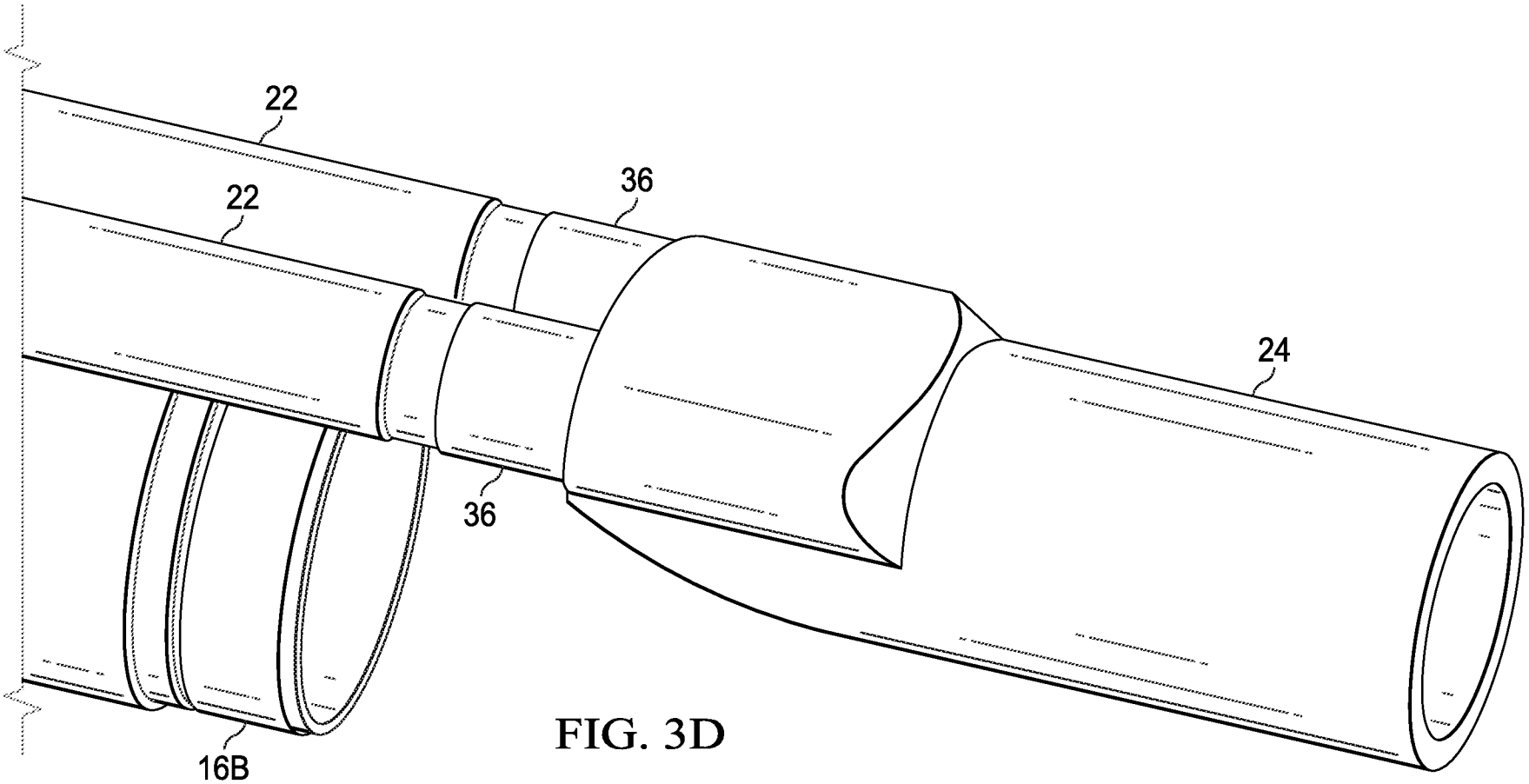

In FIG. 3C, the lateral legs 22 are partially threaded into the transition sub 24 and, in FIG. 3D, the lateral legs 22 are fully threaded into the transition sub 24. After the lateral legs 22 are screwed into the transition sub 24, the location of the gasket 40 is lodged in an annular cavity. At that point, each lateral leg 22 can be screwed into the y-block 20. Threaded interfaces 32 have a shorter length than threaded interfaces 42. As the threaded interfaces 32 are screwed into the y-block 20, the threaded interfaces 42 are backed out of the threaded interfaces 38 of the lateral bores 36. As will be discussed with reference to FIG. 4, as the threaded interfaces 42 are backed out, the gasket 40 mates with a landing pad of the transition sub 24. The gaskets 40 forms a hydraulic seal between the lateral legs 22 and the internal structure of the transition sub 24.

Figure 4A:
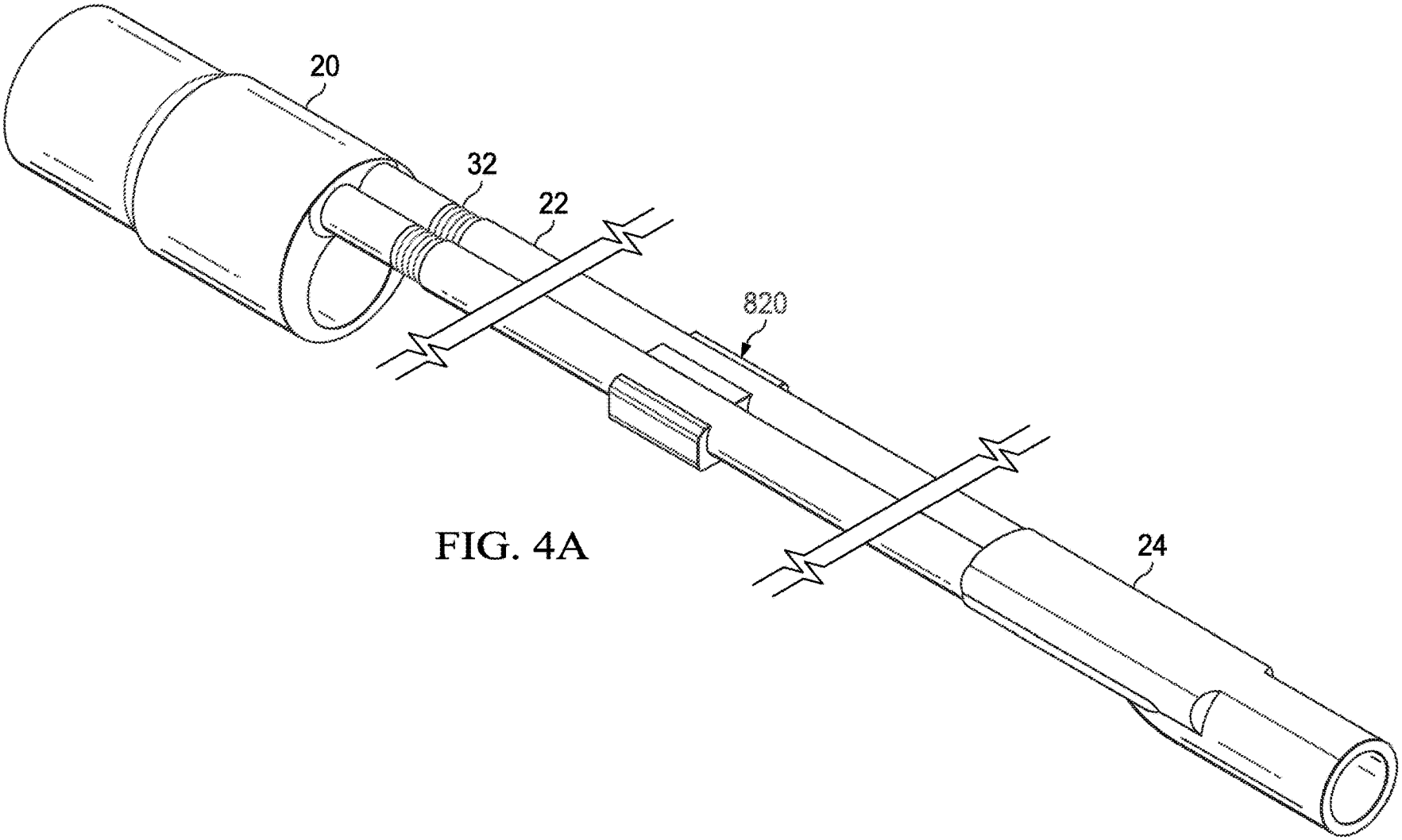
FIGS. 4A-4D, are illustrations of isometric views and cut away views of the y-block, lateral legs, a transition sub, and a stabilizer, in accordance with certain example embodiments.
Figure 4B:
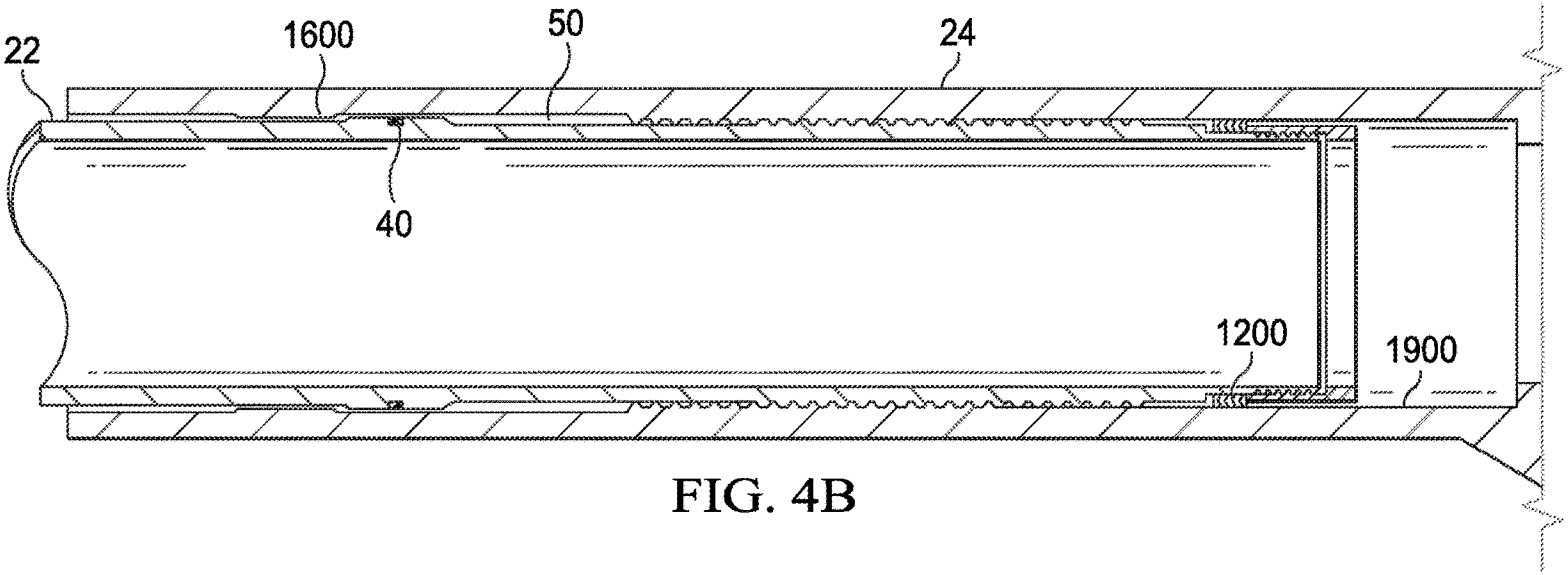
Figure 4C:
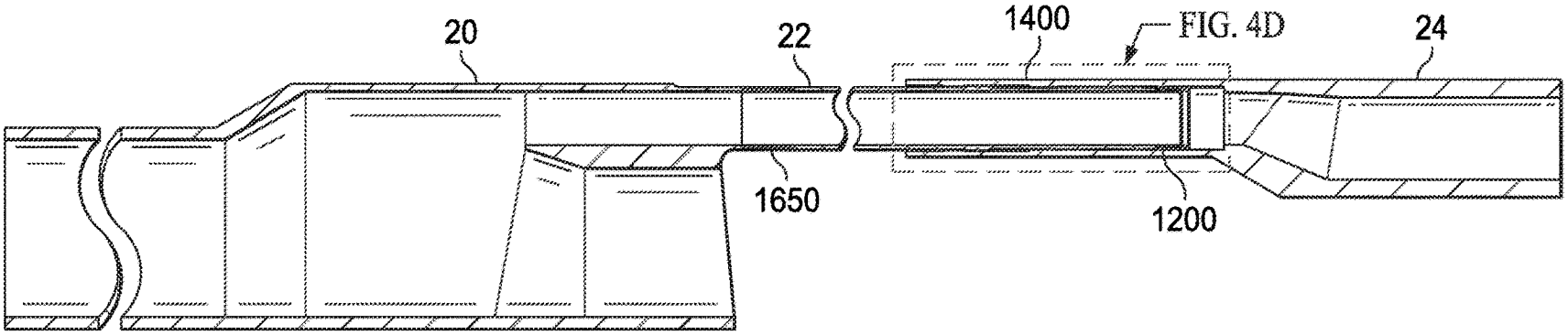
Figure 4D:
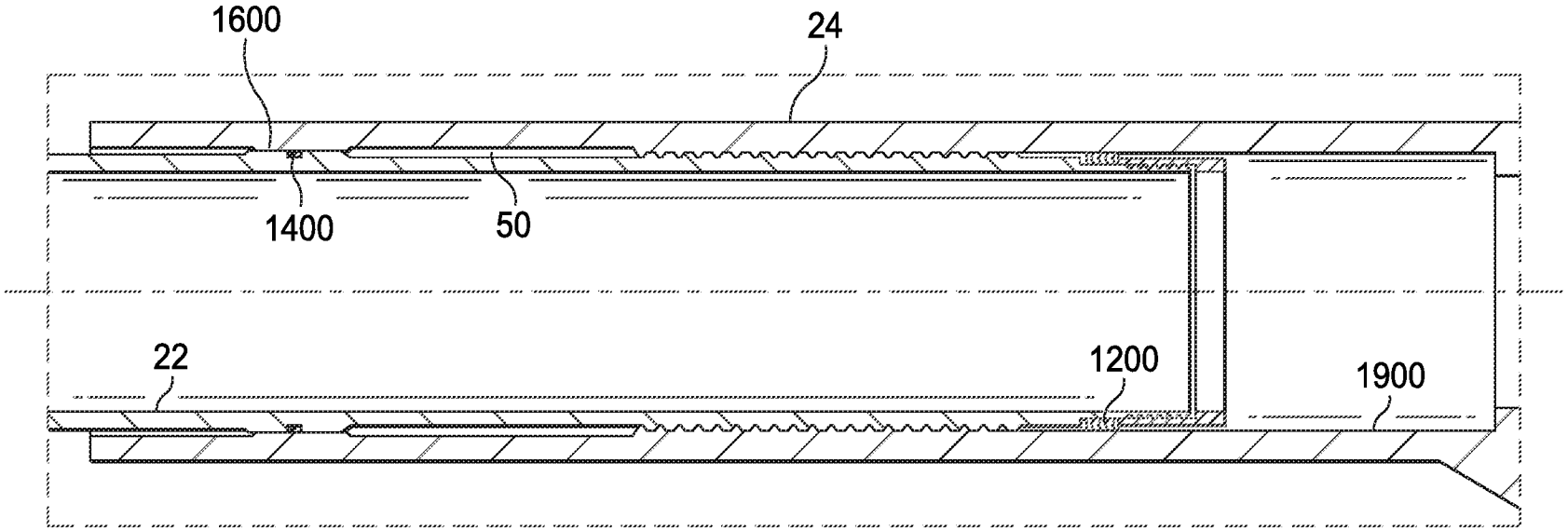

Referring now to FIGS. 4A-4C and 5A-5C, illustrated are isometric views and cut away views of the y-block 20, lateral legs 22, a transition sub 24, and a stabilizer 820, according to certain example embodiments. In FIG. 4A, each lateral leg 22 is screwed into a respective lateral bore 36 of the transition sub 24 but not screwed into the y-block 20. In FIG. 4B, the lateral leg 22 is fully coupled with the transition sub 24. In this configuration, the gasket 40 is aligned in an annular cavity 50. In FIGS. 4C and 4D, the lateral leg 22 is screwed into a respective lateral bore 28 of the y-block 20. Once each lateral leg 22 is screwed into a respective lateral 28 of the y-block 20, the gasket 40 is aligned with a respective landing pad 1600. In some embodiments, each lateral leg 22 includes another seal 1200 for sealing with an internal surface 1900 of the transition sub 24. In this way, there are two seals to form a hydraulic seal between the lateral legs 22 and the lateral bores 36 of the transition sub 24. The gasket 40 and seal 1200 can be synthetic based seals, such as elastomer. In some embodiments, threaded interfaces 30, 32 do not use synthetic materials but rather rely on a metal-to-metal seal. In some embodiments, the threaded interfaces 30, 32, 38, 42 are formed as timed threads. Timed threads involve machining the threads at the same orientation so thread engagement begins at the 12 o'clock position for the lateral legs 22. The threaded interfaces 30, 38 are either right-handed or left handed threaded interfaces. In other words, the threaded interface and the other threaded interface have the same turn orientation.

Figure 5A:
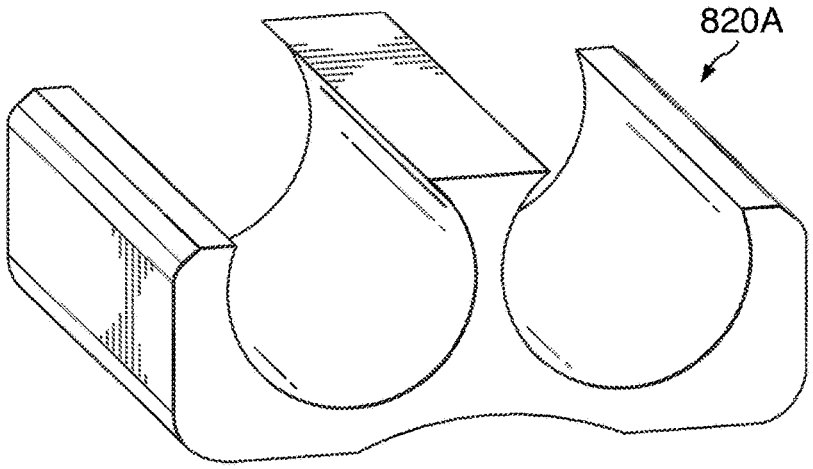
FIGS. 5A-5C, illustrated are isometric views of the stabilizer 820, in accordance with certain example embodiments.
Figure 5B:
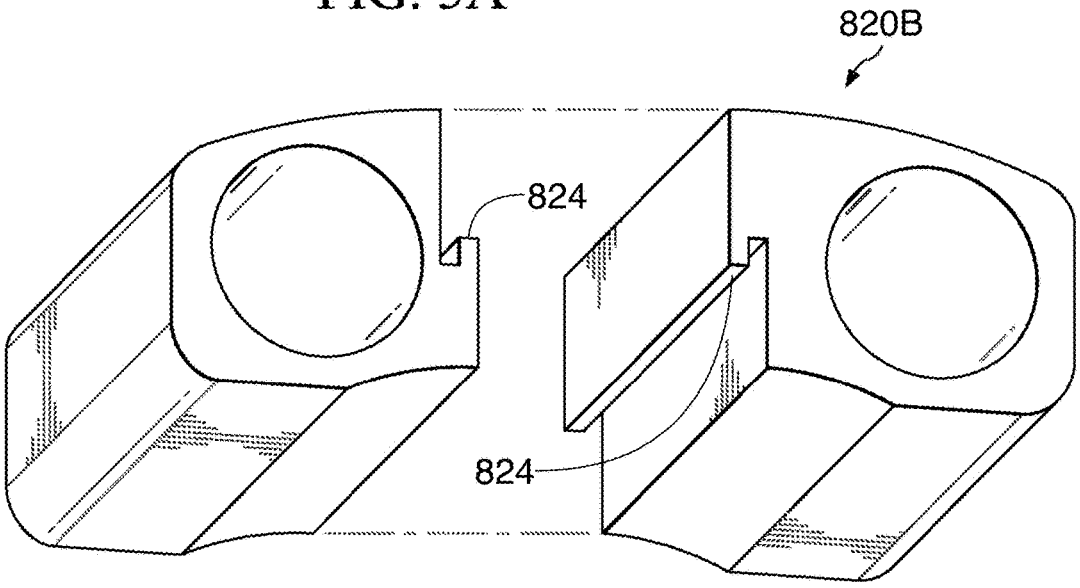
Figure 5C:
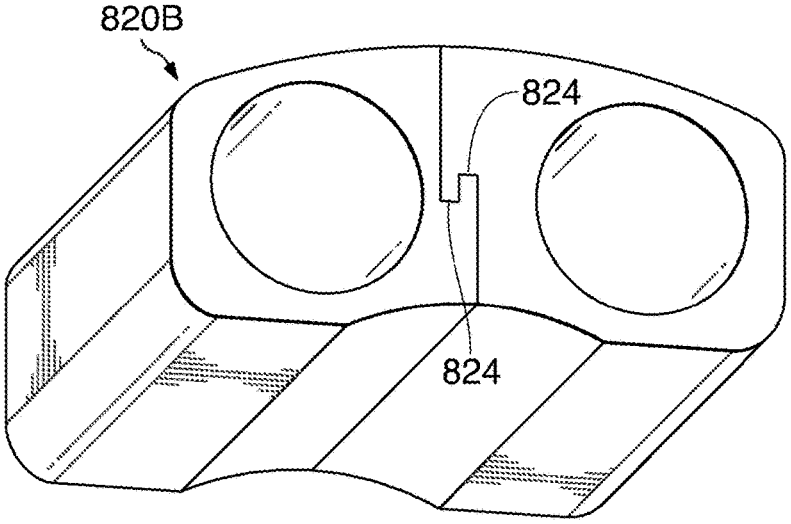

In FIG. 5A, stabilizer 820A is a single entity that can be fitted around the lateral legs 22. The stabilizer 820A stiffens the lateral legs 22 when the legs are under compressive loads while running the multilateral junction into a well. For example, if it is desired to run lateral screens into a lateral wellbore, the legs may be slightly bent and under a high compressive axial load when the junction is near the landing point. The stabilizer 820A increases a section modulus of lateral legs 22 and in turn increases the buckling and bending resistance of the lateral legs 22. In FIGS. 5B and 5C, stabilizer 820B is a multipart component. The stabilizers 820A and 820B may be secured to the lateral legs 22 with set screws (not shown) for instance. In some embodiments, the stabilizers 820A, 820B may be threaded. An advantage of the multipart stabilizer 820B is that it can be coupled together with fasteners 824. The fasteners 824 can be designed to fail under a particular scenario. For example, if debris lands on the legs 22, it may desirable to have the legs 22 separate from one another so the load from the debris does not twist the lateral legs 22, but instead allows them move independent from one another.

Figure 6:
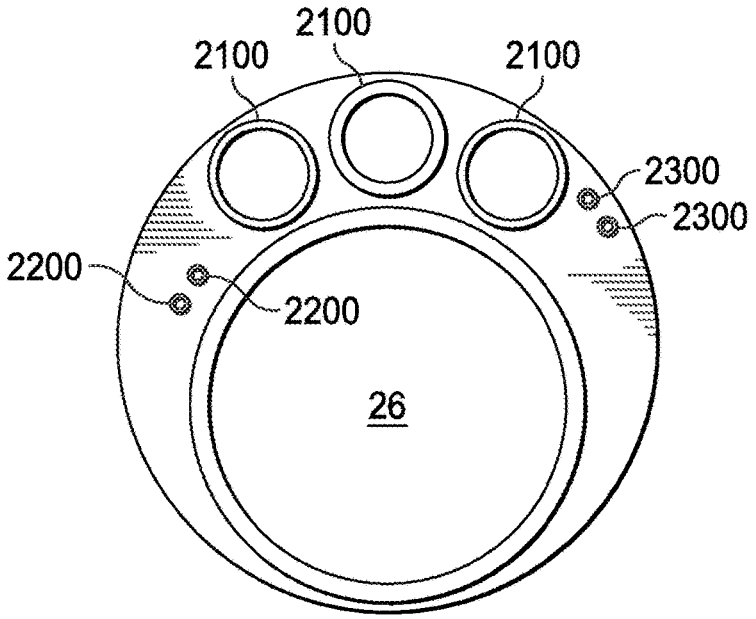
FIG. 6, illustrated is a cut away of a y-block having multiple bores and control lines, in accordance with certain example embodiments.
Figure 7:
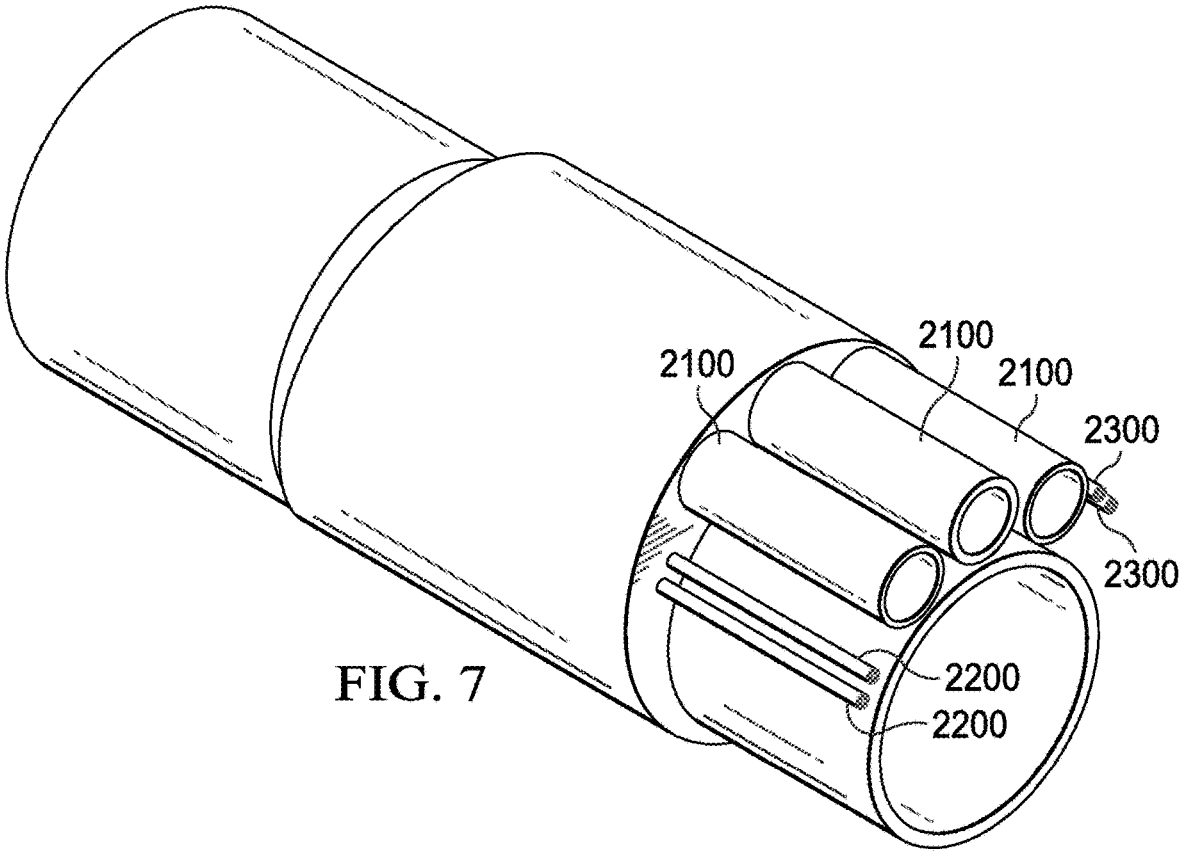
FIG. 7, illustrated is an isometric view of a y-block having multiple bores and control lines, in accordance with certain example embodiments.

Referring now to FIG. 6 and FIG. 7, illustrated is a cut away view and an isometric view, respectively, of a y-block having multiple bores 2100 and control lines 2200, according to certain example embodiments. A lateral junction may need more than 2 lateral legs in order to meet certain criteria, such as passing large tools through a main bore 26. If the main bore 26 has to be very large, it may require 3 or more lateral legs 2100 to be used in order to increase the flow area of a lateral leg. Likewise, in certain applications, there may be a need to run control lines/flat packs (which encase 1 or more control lines), either alongside the lateral leg 22 or the main bore leg 16*b*, or both.

As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. As used herein, phrases such as "between X and Y" and "between about X and Y" should be interpreted to include X and Y. As used herein, phrases such as "between about X and Y" mean "between about X and about Y." As used herein, phrases such as "from about X to Y" mean "from about X to about Y."

The above-disclosed embodiments have been presented for purposes of illustration and to enable one of ordinary skill in the art to practice the disclosure, but the disclosure is not intended to be exhaustive or limited to the forms disclosed. Many insubstantial modifications and variations will be apparent to those of ordinary skill in the art without departing from the scope and spirit of the disclosure. The scope of the claims is intended to broadly cover the disclosed embodiments and any such modification. Further, the following clauses represent additional embodiments of the disclosure and should be considered within the scope of the disclosure:

Clause 1, an apparatus for communicating fluid in downhole well environments, the apparatus comprising: a y-block having a main bore and lateral bores formed therein, the main bore having a first end for coupling with a section of tubing and another end for coupling with a main bore leg, each lateral bore having a threaded interface, the main bore having an internal diameter greater than the internal diameter of the lateral bores; and a lateral leg for each lateral bore, each lateral leg having a threaded interface to couple with the threaded interface of a respective lateral bore;

Clause 2, the apparatus of clause 1, wherein the lateral leg further comprises another threaded interface for coupling with a transition sub;

Clause 3, the apparatus of clause 2, wherein the other threaded interface has a greater number of threads than the threaded interface that couples with the threaded interface of the respective lateral bore or the threaded interface of the lateral leg;

Clause 4, the apparatus of clause 2, wherein the threaded interface and the other threaded interface have a same turn orientation;

Clause 5, the apparatus of clause 2, wherein the threaded interface and the other threaded interface have a same turn orientation and timed threads;

Clause 6, the apparatus of clause 2, wherein at least one selected from a group comprising a lower section of the other threaded interface and an upper section of the threaded interface comprises a gasket;

Clause 7, the apparatus of clause 1, further comprising at least one selected from a group a stabilizer and a multipart stabilizer for stabilizing the lateral legs;

Clause 8, the apparatus of clause 2, wherein the threaded interface of the lateral bore, the threaded interface of the lateral leg, or the other interface of the lateral leg, or any combination thereof have a same thread pitch;

Clause 9, a system for use in downhole well environments, the system comprising: a y-block having a main bore and lateral bores formed therein, the main bore having a first end for coupling with a section of tubing and another end for coupling with a main bore leg, each lateral bore having a threaded interface, the main bore having an internal diameter greater than the internal diameter of the lateral bores; at least two lateral legs, each lateral leg having a threaded interface to couple with the threaded interface of a respective lateral bore; and a transition sub for coupling with another interface of the lateral leg;

Clause 10, the system of clause 9, wherein the other interface of the lateral leg is a threaded interface;

Clause 11, the system of clause 10, wherein the other threaded interface has a greater number of threads than the threaded interface that couples with the threaded interface of the respective lateral bore or the threaded interface of the lateral leg;

Clause 12, the system of clause 10, wherein the threaded interface and the other threaded interface have a same turn orientation;

Clause 13, the system of clause 10, wherein the threaded interface and the other threaded interface have a same turn orientation and timed threads;

Clause 14, the system of clause 10, further comprising at least one selected from a group a stabilizer and a multipart stabilizer for stabilizing the lateral legs;

Clause 15, the system of clause 10, wherein the threaded interface of the lateral bore, the threaded interface of the lateral leg, or the other interface of the lateral leg, or any combination thereof comprises a metal gasket;

Clause 16, the system of clause 10, wherein the transition sub comprises an annular cavity and a landing pad;

Clause 17, a method of using a junction in a downhole well environment, the method comprising: threading an end of a first lateral leg and an end of a second lateral leg into a transition sub; threading another end of the first lateral leg and another end of the second lateral leg into a y-block; positioning a section of tubing, the y-block, a main bore leg, the first lateral leg and the second lateral leg in a section of a well, the main bore leg and the lateral leg collapsed together; positioning the lateral leg into another section of the well; pumping fluid through the section of tubing, the main bore leg, and the later leg; the y-block having a main bore and lateral bores formed therein, the main bore having a first end for coupling with a section of tubing and another end for coupling with a main bore leg, each lateral bore having a threaded interface, the main bore having an internal diameter greater than the internal diameter of the lateral bores; the lateral legs having a threaded interface to couple with the threaded interface of a respective lateral bore; and a transition sub for coupling with another interface of the lateral leg;

Clause 18, the method of clause 17, wherein the other interface of the leg is a threaded interface; wherein the other threaded interface has a greater number of threads than the threaded interface that couples with the threaded interface of the respective lateral bore or the threaded interface of the lateral leg;

Clause 19, the method of clause 17, further comprising stabilizing the lateral legs using at least one selected from a group comprising a stabilizer and a multi-part stabilizer; and Clause 20, the method of clause 17, further comprising forming a seal between the lateral legs and the transition sub.

What is claimed is:

1. A method of assembling and installing a junction for use in a downhole well environment, the method comprising:

threading an end of a first lateral leg and an end of a second lateral leg into a transition sub to couple the first lateral leg and the second lateral leg to the transition sub such that the first and second lateral legs are parallel to one another;

threading another end of the first lateral leg and another end of the second lateral leg into a y-block while the parallel first and second lateral legs are coupled to the transition sub;

positioning a section of tubing, the y-block, a main bore leg, the first lateral leg and the second lateral leg in a section of a well, the main bore leg and the first and second lateral legs positioned together;

positioning the first and second lateral legs into another section of the well; and pumping fluid through the section of tubing, the main bore leg, and the first and second lateral legs, the y-block having a main bore and lateral bores formed therein, the main bore having a first end for coupling with the section of tubing and another end for coupling with the main bore leg, each lateral bore having a threaded interface, the main bore having an internal diameter greater than the internal diameter of the lateral bores, wherein each of the first and second lateral legs has a threaded interface to couple with the threaded interface of the respective lateral bore, wherein the first and second lateral legs are positioned to extend into a single borehole after the lateral legs are coupled to the y-block during assembly.

2. The method of claim 1, wherein the threaded interface for each of the first and second lateral legs, and an other threaded interface of the respective leg have a same turn orientation.

3. The method of claim 1, wherein the threaded interface for each of the first and second lateral legs and an other threaded interface of the respective leg have a same turn orientation and timed threads.

4. The method of claim 1, wherein at least one of a lower section of an other threaded interface of one of the first or second lateral legs and an upper section of the threaded interface of one of the first or second lateral legs comprises a gasket.

5. The method of claim 1, wherein the threaded interface of the lateral bore, the threaded interface of the lateral leg, or an other threaded interface of the lateral leg, or any combination thereof have a same thread pitch.

6. The method of claim 1, wherein the threaded interface of each lateral bore, the threaded interface of each lateral leg, or an other interface of each lateral leg, or any combination thereof comprises a gasket.

7. The method of claim 6, wherein following assembly of the junction, the gasket creates a hydraulic seal with internal structure of the transition sub.

8. The method of claim 1, wherein the transition sub comprises an annular cavity and a landing pad.

9. The method of claim 8, wherein following assembly of the junction, the gasket creates a hydraulic seal with internal structure of the transition sub.

10. The method of claim 1, wherein an other interface of each of the first and second lateral legs is a threaded interface, wherein the other threaded interface has a greater number of threads than the threaded interface that couples with the threaded interface of the respective lateral bore or the threaded interface of the respective lateral leg.

11. The method of claim 1, further comprising stabilizing the first and second lateral legs using at least one of a stabilizer and a multipart stabilizer.

12. The method of claim 11, further comprising fitting the stabilizer around the first and second lateral legs to stiffen the lateral legs when the legs are under compressive loads while positioning the junction into the well.

13. The method of claim 11, wherein the multipart stabilizer includes a first part, a second part and a fastener, and the method further comprises securing the first part to the first lateral leg, securing the second part to the second later leg, and coupling the first part to the second part with the fastener, wherein the fastener is configured to fail to protect against application of a load that would damage one or both of the first and second lateral legs.

14. The method of claim 1, further comprising forming a seal between the each of the first and second lateral legs and the transition sub using a gasket.

15. The method of claim 14, wherein, as a result of the threading of the first and second lateral legs into the transition sub, the gasket is lodged in an annular cavity and each of the first and second lateral legs threaded into the y-block.

16. The method of claim 15, wherein, as the threaded interfaces of each lateral leg are threaded into the y-block, the threaded interfaces on an other end of each lateral leg are backed out of threaded interfaces of corresponding lateral bores in the transition sub.

17. The method of claim 16, as the threaded interfaces on the other end of each lateral leg are backed out, the gasket mates with a landing pad of the transition sub to form the seal between the lateral legs and internal structure of the transition sub.

18. The method of claim 1, further comprising tying the junction into another tubing section using the transition sub.

19. The method of claim 1, further comprising running at least one control line either alongside the first and second lateral legs or the main bore leg, or both.

* * * * *